United States Patent [19]

Van Der Marel et al.

[11] Patent Number: 5,066,888

[45] Date of Patent: Nov. 19, 1991

[54] ALKALI METAL VAPOUR DISPENSER

[75] Inventors: Cornelis Van Der Marel; Arnoldus D. J. Smoorenburg, Both of Eindhoven, Netherlands

[73] Assignee: U.S. Philips Corporation, New York, N.Y.

[21] Appl. No.: 401,887

[22] Filed: Aug. 31, 1989

[30] Foreign Application Priority Data

Sep. 2, 1988 [NL] Netherlands ..... 8802171

[51] Int. Cl.[5] ..... H01J 17/26; H01B 1/02

[52] U.S. Cl. ..... 313/564; 445/10; 252/514

[58] Field of Search ..... 445/9, 10; 252/181.1, 252/181.4, 514; 313/546, 547, 550, 556, 564, 422

[56] References Cited

U.S. PATENT DOCUMENTS

| | | | |
|---|---|---|---|
| 3,096,211 | 7/1963 | Davis | 313/564 |
| 3,945,949 | 3/1976 | Van Vucht et al. | 313/564 |
| 4,195,891 | 4/1980 | Hellier | 445/10 |
| 4,853,585 | 8/1989 | Hoeberechts et al. | 313/422 |

*Primary Examiner*—Sandra L. O'Shea
*Assistant Examiner*—Diab Hamadi
*Attorney, Agent, or Firm*—John C. Fox

[57] ABSTRACT

Cesium dispenser with a metal carrier (for example, Al or Ag) in which silicon-alkali metal compounds or germanium-alkali metal compounds are present along the grain boundaries of the carrier material.

10 Claims, 1 Drawing Sheet

ALKALI METAL VAPOUR DISPENSER

CROSS REFERENCE TO RELATED APPLICATION

U.S. patent application Ser. No. 07/401,888, filed simultaneously herewith, relates to the dispensing of alkali metal vapor by heating grains of silicon or germanium coated with a compound of the alkali metal and the silicon or germanium;

BACKGROUND OF THE INVENTION

The invention relates to a device for releasing metal vapour of an alkali metal upon heating.

Such devices (dispensers) are used, for example in tubes comprising photocathodes (brightness intensifiers, X-ray image intensifiers) and photomultiplier tubes to deposit a thin layer of the metal, for example cesium on the cathode decrease the work function of the electrons emitted by the cathode. This type of dispenser may also be used in display tubes comprising semiconductor cathodes.

A device of the type mentioned in the opening paragraph is described in GB 1,265,197 in which the powder comprises an alkali chromate such as cesium chromate. When heated the chromate powder is decomposed so that pure cesium is released.

One of the drawbacks of such a device is that the dimensions of the pulverulent grains of the chromate are so small that the powder exhibits poor flow properties, making it difficult to fill the holders in a regular manner and making it difficult to manufacture the dispensers in a reproducible manner.

A second drawback is the emission of unwanted gases during the supply of the alkali metal. Such dispensers often comprise silicon and zirconium-aluminium in addition to the chromate for binding oxygen which is released during the decomposition reaction Zirconium-aluminum in particular emits absorbed hydrogen and hydrocarbon gases at the decomposition temperature of the various alkali chromates (700°-800° C. Also the envelope, which usually consists of nickel-chromium steel, emits these absorbed gases, notably carboncontaining. Particularly the latter gases have a detrimental influence on the operation of photocathodes and semiconductor cathodes.

Moreover, since the alkali metal is supplied by decomposition, the supply of the alkali metal is difficult to control or is not controllable at all.

SUMMARY OF THE INVENTION

It is an object of the invention, to provide a device of the type described in the opening paragraph which can be manufactured in a more reproducible manner.

It is a further object of the invention to provide a device in which the release of the alkali metal vapour is controllable.

Moreover, it is an object of the invention to reduce the emission of the unwanted gases in such a device as much as possible.

The invention is based on the recognition that this can be achieved by releasing the alkali metal by means of diffusion instead of by a decomposition reaction.

Furthermore, the invention is based on the recognition that such a release method can be realised by refraining from pulverulent mixtures.

To this end a device according to the invention is characterized in that it comprises a metal carrier consisting at least partly of particles which comprise a silicon alkali metal compound (or germanium alkali metal compound).

Preferably, the carrier is wire-shaped. In the case of a silicon-cesium compound (such as $CsSi_4$) cesium is released at approximately 530° C. and diffuses to the exterior. The diffusion rate and hence the cesium supply can be controlled by means of the heating temperature.

Since the filling process is now replaced by a diffusion process of distributing alkali metal in the carrier material, such a dispenser can be manufactured in a reproducible manner.

Moreover, the emission of unwanted gases is considerably lower due to the lower operating temperature.

Suitable metals for the carrier are Al, Ag, Cu, Fe, Pt, Ti, V and W, while preferably Cs, Na, K and Ru are chosen for the alkali metals.

Sodium, potassium and rubidium are very suitable for use for example brightness intensifiers and X-ray image intensifiers comprising photocathodes, while cesium is preferably used in photomultiplier tubes and display) tubes having semiconductor cathodes.

To obtain a directed release of vapour, the carrier may be partly provided with a layer of, for example chromium, which is impenetrable to the alkali metal. This is particularly advantageous in a device as proposed in U.S. Pat. No. 4,853,585, Aug. 1, 1989, in the name of the Applicant, in which device a plurality of semiconductor cathodes is mounted side by side so that a slit-shaped aperture may be used in a cesium dispenser facing the row of cathodes. Moreover, the extra layer protects the wire from melting. A directed release of the alkali metal can also be obtained by accommodating the carrier in a holder which has an aperture of the desired shape (for example, a slit.

BRIEF DESCRIPTION OF THE DRAWING

The invention will now be described in greater detail with reference to an example and the accompanying drawing in which.

DESCRIPTION OF THE PREFERRED EMBODIMENTS

A device according to the invention is obtained by starting from a preferably wire-shaped holder of silver or aluminium containing up to 10% by weight of silicon. Since the carrier material does not react with or hardly reacts with the silicon, the latter is predominantly present along the grain boundaries of the carrier material. This silicon may form a silicon-cesium compound with cesium (for example $CsSi_4$) in a manner which is analogous to that described in U.S. patent application Ser. No. 07-401,888 filed simultaneously herewith, in which the carrier is coated with metallic cesium under suitable circumstances (1 atm argon pressure, T=28° C.) and is subsequently heated. During heating cesium diffuses along the grain boundaries and is bound to the silicon (in the form, for example, of $CsSi_4$). The duration of the diffusion is dependent on the temperature used (several hours at 550° C.). The compounds thus formed are shielded from their ambient so that the device is substantially chemically stable.

Figure 1:
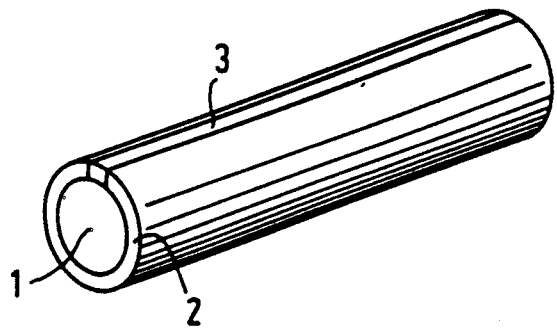
FIG. 1 is a diagrammatic representation of a first embodiment of the invention.

Such a wire-shaped cesium source (dispenser) as shown in FIG. 1, for example, can be mounted in a vacuum tube (not shown), for example, opposite a row of semiconductor cathodes as described in U.S. Pat. No. 4,853,585. During heating from approximately 530° C., cesium is released from the $CsSi_4$; and diffuses to the exterior via the grain boundaries. Heat may be supplied, for example, by resistance heating of the diffusion rate and hence the cesium supply is controllable by adjusting the temperature. The wire (carrier).

A directed supply of the cesium can be obtained as shown in FIG. 1 by chromium-plating the layer part of the surface area of the wire 1 with a protective layer 2 so that a narrow slit remains for the supply of the cesium. Moreover, the wire is now better protected against melting because the melting point is about 600° C. To prevent unwanted gas supply during the supply of cesium, the slit may be provided with a thin layer 3 of gold or galvanic nickel. These materials pass cesium, but are barriers to oxidizing gases.

Figure 2:
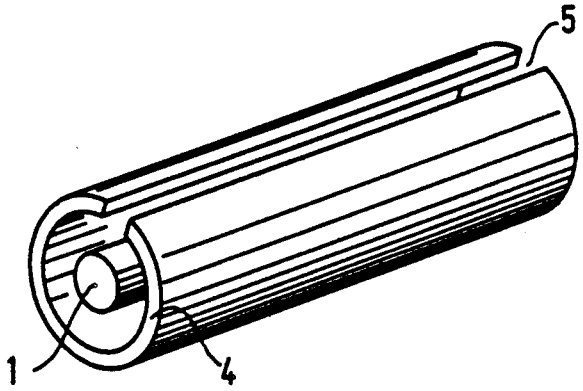
FIG. 2 is a diagrammatic representation of a second embodiment of the invention.

Such a supply can also be achieved by accommodating the wire 1 for the greater part or entirely in a nickel-chromium envelope 4 which has one or more apertures (for example a slit 5), in the way shown in FIG. 2.

The invention is of course not limited to the example described. Other metals which are electrically conducting and do not react with cesium up to approximately 600° C. can also be chosen for the carrier. These requirements are satisfied by, for example, nickel, copper, iron, platinum, titanium, vanadium and tungsten.

Instead of cesium, a different alkali metal may alternatively be chosen, for example sodium or potassium, while silicon may be replaced by germanium. The manufacturing conditions then of course change, and the carrier metal need not be the same.

In addition to the example of a thin vacuum tube, alkali metal sources according to the invention can also be used very satisfactorily in other electron tubes (High Brightness Gun) and also in photocathodes (brightness intensifiers, X-ray image intensifiers) and in photomultiplier tubes.

Also suitable metal wires or other metal parts present in a vacuum tube may be used as carriers, such as bonding flaps or interconnection wires of, for instance, semiconductor cathodes.

We claim:

1. A device for releasing metal vapour of an alkali metal by heating, characterized in that the device comprises a metal carrier of a metal which does not react with or hardly reacts with silicon or germanium, and up to 10% by weight of silicon or germanium, predominantly present along the grain boundaries of the carrier material, and present at least partly in the form of a silicon alkali metal compound or germanium alkali metal compound.

2. A device as claimed in claim 1, in which the carrier is wire-shaped.

3. A device as claimed in claim 1, in which the carrier comprises at least one metal selected from the group consisting of aluminium, silver, copper, iron, platinum, titanium, vanadium and tungsten.

4. A device as claimed in claim 1, in which the alkali metal is at least one selected from the group consisting of sodium, potassium, rubidium and cesium.

5. A device as claimed in claim 1, which the carrier is at least partly coated with a layer which is impenetrable to the alkali metal.

6. A device as claimed in claim 5, in which an aperture is formed in the layer which is impenetrable to the alkali metal and a material penetrable by the alkali metal is formed in the aperture.

7. A device as claimed in claim 5, in which the impenetrable layer comprises chromium.

8. A device as claimed in claim 6, in which the material penetrable by the alkali metal comprises gold or tin.

9. A device as claimed in claim 1, in which the carrier is present in a holder having at least one aperture.

10. A device as claimed in claim 9, in which the aperture is slit-shaped.

* * * * *